US009263014B2

(12) United States Patent
Brandt et al.

(10) Patent No.: US 9,263,014 B2
(45) Date of Patent: Feb. 16, 2016

(54) METHOD AND APPARATUS FOR AUDIO EFFECTS CHAIN SEQUENCING

(71) Applicants: Andrew John Brandt, Minneapolis, MN (US); Adam Edward Malone, Minneapolis, MN (US)

(72) Inventors: Andrew John Brandt, Minneapolis, MN (US); Adam Edward Malone, Minneapolis, MN (US)

( * ) Notice: Subject to any disclaimer, the term of this patent is extended or adjusted under 35 U.S.C. 154(b) by 42 days.

(21) Appl. No.: 14/211,175

(22) Filed: Mar. 14, 2014

(65) Prior Publication Data

US 2014/0270214 A1 Sep. 18, 2014

Related U.S. Application Data

(60) Provisional application No. 61/782,336, filed on Mar. 14, 2013.

(51) Int. Cl.
*G10H 1/00* (2006.01)

(52) U.S. Cl.
CPC ..... *G10H 1/0091* (2013.01); *G10H 2210/281* (2013.01)

(58) Field of Classification Search
CPC ..... G10H 1/0091; G10H 2210/281; G10H 2210/311
USPC ..... 84/622, 635, 662, 746; 370/394, 310; 381/61, 73.1; 463/42; 700/94; 710/8; 712/35; 717/153; 703/13; 704/500; 725/46
See application file for complete search history.

(56) References Cited

U.S. PATENT DOCUMENTS 4,509,190 A * 4/1985 Spector ..... 381/61
5,130,662 A 7/1992 Jorgensen et al.
5,511,002 A * 4/1996 Milne ..... G06F 17/30017 707/E17.009
5,706,262 A * 1/1998 Yokota ..... G11B 27/034 369/30.09
6,119,091 A * 9/2000 Huang ..... G11B 20/10527 381/119
6,347,998 B1 * 2/2002 Yoshitomi et al. ..... 463/42
6,369,835 B1 * 4/2002 Lin ..... 715/726
6,664,460 B1 * 12/2003 Pennock et al. ..... 84/662
6,868,296 B1 3/2005 Arikuma et al.
6,996,699 B2 * 2/2006 Chrysanthakopoulos et al. ..... 712/35
7,076,774 B2 * 7/2006 Chrysanthakopoulos et al. ..... 717/153
7,107,110 B2 * 9/2006 Fay et al. ..... 700/94
7,209,482 B1 * 4/2007 Rahim ..... 370/394
7,343,210 B2 * 3/2008 DeVito et al. ..... 700/94
7,877,156 B2 * 1/2011 Fujimoto et al. ..... 700/94
8,324,494 B1 * 12/2012 Packouz ..... 84/635
8,578,059 B2 * 11/2013 Odayappan et al. ..... 710/8
8,609,973 B2 * 12/2013 D'Amours ..... 84/746
8,861,742 B2 * 10/2014 Koike et al. ..... 381/73.1
8,907,196 B2 * 12/2014 Vainiala ..... 84/622
2007/0124769 A1 * 5/2007 Casey ..... H04H 20/10 725/46
2008/0126054 A1 * 5/2008 Cohen ..... G06Q 10/08 703/13
2008/0137564 A1 * 6/2008 Herrmann ..... H04L 1/1642 370/310
2013/0327201 A1 12/2013 Urry et al.
2014/0270214 A1 * 9/2014 Brandt et al. ..... 381/61

* cited by examiner

*Primary Examiner* — Gerald Gauthier
(74) *Attorney, Agent, or Firm* — William Mitchell IP Clinic

(57) ABSTRACT

An audio effects chain sequencing apparatus alters the sequence of effects units in an effects chain so that different sequences of effects units can be connected. In one example the audio effects chain sequencing apparatus can have an external input port and an external output port, at least two component ports each having an internal input port and an internal output port, where the at least two component ports receive an input from the external input port, transfer that input in a component sequence to the component ports, and transfer the input to the external output port at the end of the component sequence and having a sequence selection module which selects the component sequence in which the at least two component ports transfer the input.

18 Claims, 4 Drawing Sheets

METHOD AND APPARATUS FOR AUDIO EFFECTS CHAIN SEQUENCING

RELATED APPLICATION

This application claims priority to U.S. Provisional Application No. 61/782,336, entitled Method and Apparatus for Audio Effects Chain Sequencing, filed on Mar. 14, 2013 which is incorporated herein by reference for all purposes.

FIELD OF THE INVENTION

The present disclosure relates to the field of audio effects units and more specifically to changing the order of effects in an effects chain.

BACKGROUND

Electric/electronic instruments can use stand-alone effects units which alter how an instrument's audio source sounds. A user of such stand-alone effects units can form an effects chain by connecting two or more effects units together and inserting that effects chain between an audio source and an amplification system.

The order of the audio effects in the effects chain can alter the sound from an amplification system. For example, an electric guitar can be connected to two different audio effects units that are chained together, such as a reverb effects unit and a distortion effects unit. The signal produced by an effects chain including a connection first into the reverb effects unit and second into the distortion effects unit can have a noticeably different sound from the signal produced by an effects chain comprising a connection first into the distortion effects unit and second into the reverb effects unit. In mathematical terms, the chaining of effects may not be a commutative process.

One problem presented by effects chains is that if the user wishes to change the sequence of effects units in an effects chain in order to produce a different type of sound, the effects chain generally needs to be disconnected and reconnected into the desired order. This process can be time consuming, and reordering effects units while the effects units are in use may not be practical. One method of quickly changing the order of effects units is presented by channel switches, which allow a user to alter the path of the audio source into a different effects chain. However, additional problems can be posed by this attempt to change the sequence of effects units as this requires the user to purchase multiple effects units of the same type and to set up all needed effects chains prior to use.

Accordingly, there is a need in the audio effects industry for an apparatus which can provide an improved manner of changing the sequence of audio effects units connected in an effects chain.

SUMMARY

The present disclosure relates generally to an audio effects chain sequencing apparatus to be used to alter the sequence of effects units in a effects chain. The audio effects apparatus can include an external input port and an external output port, at least two component ports, and a sequence selection module, configured to direct an input, from the external input port, through each of the component ports in a component sequence, and transfer the input to the external output port at the end of the component sequence. The component ports can each include an internal input port and an internal output port.

The component ports, the external input port, and the external output port can be connectable to 3.5 mm mono plugs, 3.5 mm stereo plugs, 6.3 mm mono plugs, 6.3 mm stereo plugs, XLR plugs, MIDI cables, or any other cable, port, socket or plug capable of carrying an audio signal. The input can also be an analog signal or a digital signal.

The audio effects chain sequencing apparatus can include a bypass module configured to bypass at least one of the component ports from the component sequence. The audio effects apparatus can also include a component power supply configured to power at least one component connectable to the component ports. The component power supply can also be at least one of an Alternating Current (AC) power source or a Direct Current (DC) power source.

The audio effects chain sequencing apparatus can include memory to store a sequence identification value, where the sequence selection module is further configured to receive the sequence identification value from the memory and to select a component sequence based on the sequence identification value. The audio effects chain sequencing apparatus can be further configured so that the memory stores multiple values generated by a user interface. The memory can also store software configured to operate the audio effects chain apparatus.

The audio effects chain sequencing apparatus can further include a user interface where the user interface generates a value stored in the memory. The user interface can include a keypad, function buttons, a scrolling mechanism, a touch pad/screen, a display, and speakers. The user interface can also use a display to display sequence identification values stored in the memory. The user interface can also be configured to allow editing of the sequence identification values stored in the memory. The sequence selection module can also be a programmable microprocessor. In one or more embodiments the audio effects chain sequencing apparatus can further include at least one mixing module configured to receive the input and configured to apply a mixing effect on the input.

A method of component sequence reordering may be provided and can include obtaining a sequence identification value, identifying a component sequence based on the sequence identification value, and configuring a circuit to transfer an input through at least two components in the component sequence. The method of component sequence reordering can further include storing the sequence identification value in a local memory, where obtaining the sequence identification value involves retrieving the sequence identification value from the local memory. The method of component sequence reordering can further include locally generating the sequence identification value where obtaining the sequence identification value involves retrieving the locally generated sequence identification value from a local memory.

These and various other features are pointed out with particularity in the claims attached herein. However, for a better understanding of variations, reference should be made to the drawings, and to the accompanying descriptive matter, in which there are illustrated and described examples.

BRIEF DESCRIPTION OF THE DRAWINGS

The audio effects chain sequencing apparatus is described in connection with example embodiments illustrated in the following diagrams.

DETAILED DESCRIPTION

In the following description, reference is made to the accompanying drawings which show by way of illustration various examples by which the disclosure may be used. Other examples of the disclosure can be used, as structural and operational changes may be made without departing from the scope of the present disclosure.

The present disclosure, in some embodiments, relates to the manipulation of audio effects units. More specifically, the disclosure relates to the manipulation of the sequence in which an audio input from an electronic or electric instrument travels through a series of audio effects units in the audio input's path to an output device. However, the disclosed apparatuses and methods also may be used to receive any type of signal from any type of external input, altering the sequence by which that input transfers through any type of connected components, and sending that input to any type of external output.

The audio effects chain sequencing apparatus can include an external input port and an external output port, at least two component ports, and a sequence selection module. The component ports can be configured to receive an input from the external input port, transfer that input in a component sequence to each of the component ports and transfer the input to the external output port after the input has traveled through the component sequence. The sequence selection module can be configured to allow a user to alter the sequence in which the component ports transfer inputs.

Figure 1:
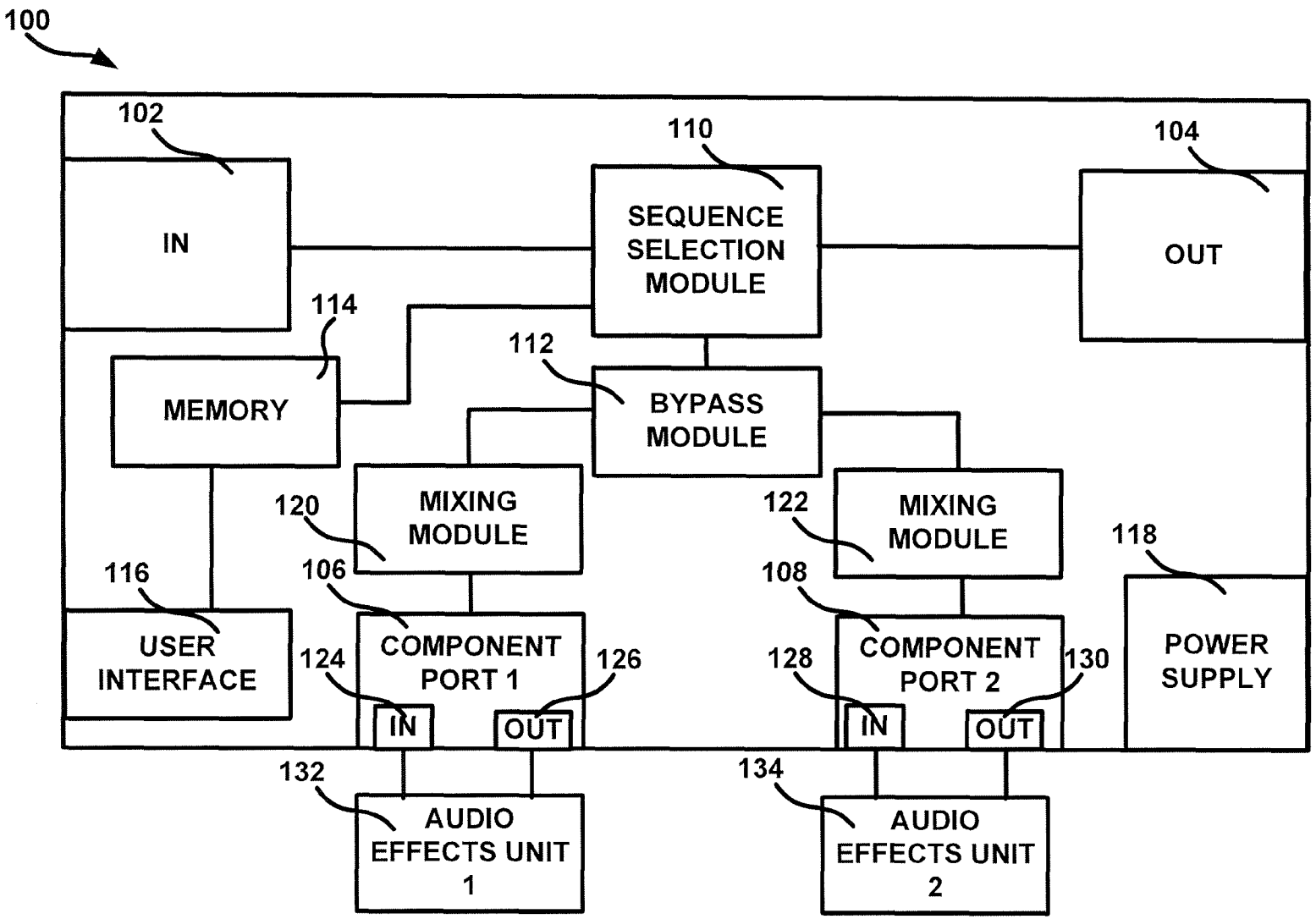
FIG. 1 is a logical block diagram of an example of an audio effects chain sequencing apparatus.

Referring now to FIG. 1, an audio effects chain sequencing apparatus 100 can include an external input port 102, an external output port 104, first and second component ports 106, 108, a sequence selection module 110, a bypass module 112, a memory 114, a user interface 116, a power supply 118, one or more mixing modules 120 and 122, internal input ports 124, 128, and internal output ports 126, 130.

The external input port 102 and external output port 104 can be substantially similar. The external input port 102 can be configured to receive an input signal and transfer the input signal to the sequence selection module 110 and the external output port 104 can be configured to receive an output signal from the sequence selection module 110 and transfer the output signal to another device such as, for example, an amplifier. The external input port 102 and the external output port 104 can both be constructed as a connection port, that can allow the audio effects chain sequencing apparatus to be connected to a source of an audio input and connected to an output device that receives the audio input from the audio effects chain sequencing apparatus. The input signal can be from an electric or electronic instrument, for example. The size, shape, diameter and type of connection port for the external input port 102 and external output port 104 can take several different forms and can allow the effects chain sequencing apparatus 100 to connect to an external input and output. The external input port 102 and the external output port 104 can each use a 6.3 mm stereo jack plug, connectable to a typical electric guitar and amplifier. The external input port 102 and external output port 104 can use other connections in lieu of a 6.3 mm stereo jack plug, including 3.5 mm mono plugs, 3.5 mm stereo plugs, 6.3 mm mono plugs, XLR plugs, MIDI cable plugs, other type of plug/socket, other shape, or other diameter which can allow for external inputs and outputs to be connected to the audio effects chain sequencing apparatus 100. Further, the external input port 102 and the external output port 104 can individually use different sizes, shapes, diameters and types of plugs. The external input port 102 and external output port 104 can use removable/insertable plugs so that different sizes, shapes, diameters, and types of plugs can be interchanged. The external input port 102 and external output port 104 can also use Bluetooth, WiFi, or other wireless connections.

The component ports 106, 108 can be substantially similar. The component ports 106, 108 can be configured to receive input from one or more effects devices, such as guitar effects pedals or other audio effects units. Each component port 106, 108 can include an internal input port 124, 128, and an internal output port 126, 130. The internal input port 124, 128 and the internal output port 126, 130 can allow for the input and output port of a typical audio effects unit 132, 134 to be connected to the effects chain sequencing apparatus 100. The size, shape, diameter and type of connection port for the internal input port and internal output port can take several different forms and can allow the effects chain sequencing apparatus 100 to connect to an external input and output. The internal input port 124, 128 and the internal output port 126, 130 can each use a 6.3 mm stereo jack plug, connectable to a typical electric guitar and amplifier. The internal input port and internal output port can be interchanged with other sizes, shapes, diameters and types of plugs, including 3.5 mm mono plugs, 3.5 mm stereo plugs, 6.3 mm mono plugs, XLR plugs, MIDI cable plugs, or other type of plug/socket or wireless connection which allows for inputs and outputs to be connected to the component ports 106, 108. A component port 106, 108 can use the same type of plug for its respective internal input port 124, 128 and internal output port 126, 130. However, the component ports 106, 108 can individually use different sizes, shapes, diameters, and types of plugs. The internal input port 124, 128 and internal output ports 126, 130 can also use removable/insertable plugs so that different sizes, shapes, diameters and types of plugs can be interchanged. While two component ports are shown, it is appreciated that any number of component ports can be provided and adapted to interface with an audio effects unit.

The sequence selection module 110 can be configured to change the component sequence by which an input travels through audio effects units, or other components, connected to the audio effects chain apparatus 100 by configuring one or more switching units which direct the path of the audio input within the audio effects chain apparatus 100. The design of the sequence selection module 110 can be implemented in various ways including using a microcontroller configured to trigger one of more switching units, and one or more manual two way and/or three way switches, one or more multiplexers, or one or more switches and/or multiplexers as switching units configured to alter the path of the audio input. The sequence selection module 110 can use a sequence identifier, which can identify a component sequence. A sequence identifier can be represented by a numerical value or series of numerical values as a sequence identification value. Multiplexers can be used with a sequence identification value to configure the multiplexers into forming the desired component sequence. A series of numerical values for each component port can identify a component sequence by identifying the positions of switches, multiplexers, or other types of switches to the sequence selection module.

The bypass module 112 can bypass one or more component ports 106, 108 in the audio effects chain sequencing apparatus 100 to allow audio effects units 132, 134 and/or component ports 106, 108 to be removed from a component sequence. The bypass module 112 can allow audio effects units to be removed from a component sequence easily and quickly without physically removing the audio effects unit 132, 134 from the audio effects chain sequencing apparatus 100. Further, where there are more component ports 106, 108 than connected audio effects units, the bypass module 112 can allow the audio input to travel from the external input port 102 to the external output port 104 without the use of connecting cables to bridge unused component ports 106, 108. The bypass module 112 can be configured similarly to the sequence selection module 110 so that the bypass module can be configured to bypass a component port 106, 108 after accessing a sequence identifier, which can identify a component sequence. The bypass module can be constructed in a variety of ways, including one or more switches, a programmable microcontroller and one or more switches and/or multiplexers, or other type of manual or programmable switch or switches which can provide a bypass across component ports 106, 108.

The memory 114 can be configured to provide storage for the audio effects chain sequencing apparatus 100 including storing sequence identifiers, storing relevant software for carrying out apparatus operations, or other data or software. Storing sequence identifiers can allow the sequence selection module 110 to access that sequence identifier and to establish the corresponding component sequence without having to generate a new sequence identifier. The memory can be made of non-volatile memory so that stored data and/or software is not lost if the audio effects chain sequencing apparatus 100 is not powered. The memory 114 can be constructed from many different types of memory including read-only memory (ROM) and programmable and/or erasable ROM, random access memory (RAM), subscriber interface module (SIM), smart card, or other fixed or removable memory device.

The user interface 116 can be configured to allow a user to input data into the memory 114, the sequence selection module 110, the bypass module 112, the mixing modules 120, and 122, and/or other elements of the audio effects chain sequencing apparatus 100. The user interface 116 can be configured to generate a sequence identifier which can be stored in memory 114 and/or accessed by the sequence selection module 110 and/or the bypass module 112. The user interface can allow a user to access sequence identifiers stored in memory 114 and can allow a user to edit stored sequence identifiers. To perform these or other functions, a processor can be tied to the user interface 116. The user interface 116 can include a keypad, function buttons, scrolling mechanism, touch pad/screen, and/or other user entry and interaction mechanisms. A user interface 116 can be provided which can allow the user of the audio effects chain sequencing apparatus 100 to perceive information visually and/or audibly. A display and/or speaker can be included with user interface 116. Other user interface 116 mechanisms can alternatively be provided.

The power supply 118 can supply alternating current (AC) or direct current (DC) power to power aspects of the audio effects chain sequencing apparatus 100, audio effects units 132, 134, or other external components. The power supply 118 can include a number of plugs equal to the number of component ports 106, 108 so that each audio effects unit 132, 134 connected to the audio effects chain sequencing apparatus 100 can be powered. The power supply 118 can use battery power, or other power sources to power the audio effects chain sequencing apparatus 100 and other external components.

The mixing module 120, 122 of the audio effects chain sequencing apparatus 100 can further include at least one mixing module configured to receive an audio input and configured to apply an audio effect on the input. A mixing module can be represented by other types of audio effects units, including effects pedals, mixing units, or other types of devices which allow for alteration of the audio input. Example mixing units can allow for multiple sounds to be combined into one or more channels and/or can allow for alteration of the input's level, frequency content, dynamics and panoramic position, or dry/wet ratio.

Figure 2A:
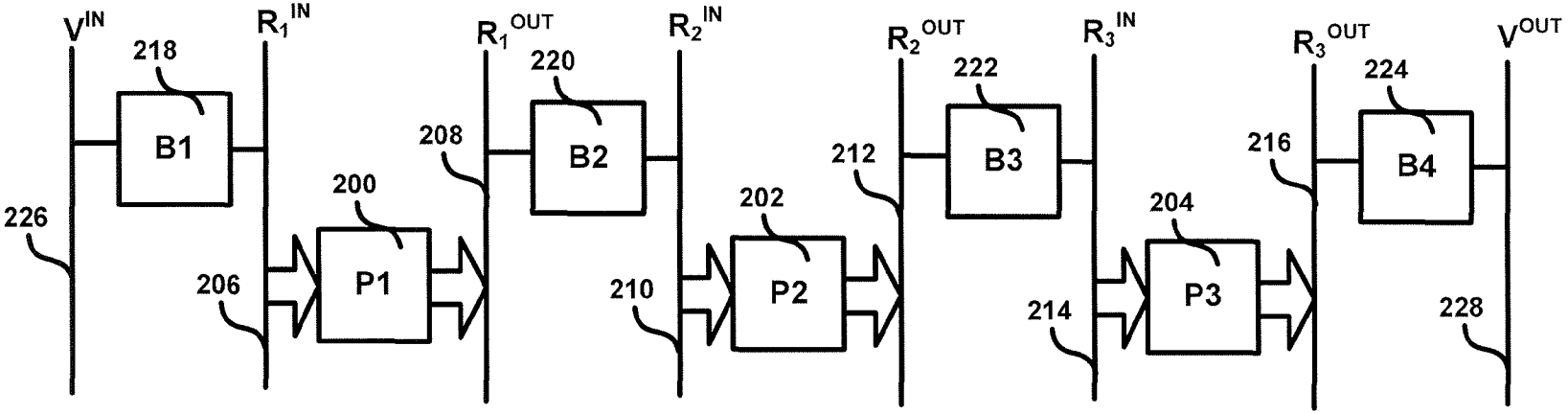
FIG. 2*a* is a flow diagram of a configuration of component ports in a component sequence using three component ports.

Referring now to FIG. 2*a*, an exemplary configuration of a component sequence is shown which transfers the audio input from an external input port to an external output port via a number of component. There are three total components $P_1$ 200, $P_2$ 202, $P_3$ 204. The components can be connected in a component sequence, $P_1$, $P_2$, $P_3$. The internal input port $R_1^{IN}$206, can first receive the audio input from switching unit $B_1$ 218, which can be configured to connect to external input port $V^{IN}$ 226 and the internal input port $R_1^{IN}$ 206. The input can travel through component one $P_1$ 200, to the internal output port $R_1^{OUT}$ 208. Internal output port $R_1^{OUT}$ 208, can send the audio input to switching unit $B_2$ 220, which can be configured to connect to the internal input port $R_2^{IN}$ 210. The input can travel through component two $P_2$ 202, to the internal output port $R_2^{OUT}$ 212. Internal output port $R_2^{OUT}$ 212, sends the audio input to switching unit $B_3$ 222, which is configured to connect to the internal input port $R_3^{IN}$ 214. The input travels through component three $P_3$ 204, to the internal output port $R_3^{OUT}$ 216. Internal output port $R_3^{OUT}$ 216, sends the audio input to switching unit $B_4$ 224, which is configured to connect to the external output port $V^{OUT}$ 228.

Figure 2B:
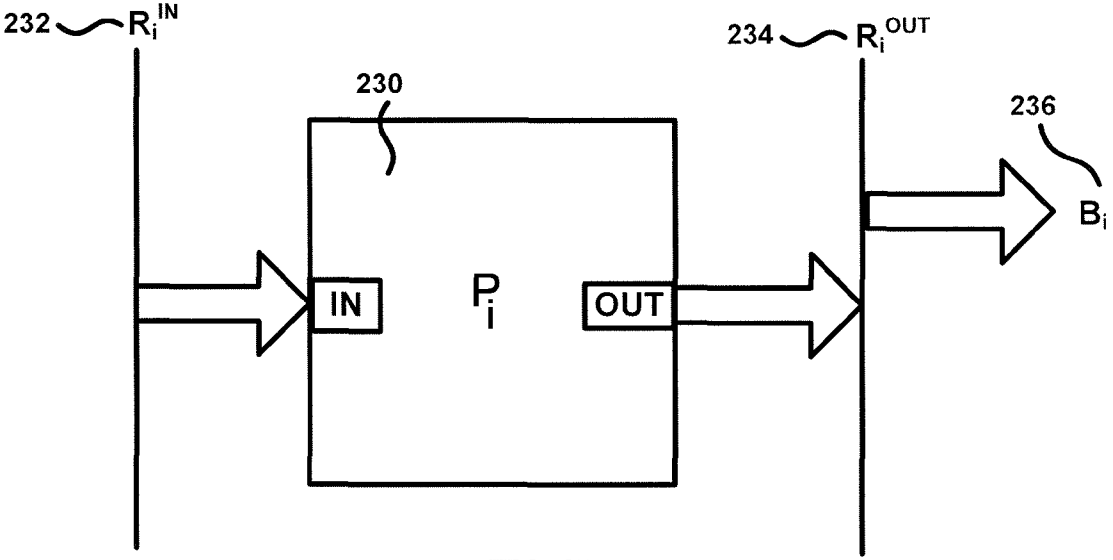
FIG. 2*b* is a flow diagram of a configuration of component ports.

Referring now to FIG. 2*b*, for k total component ports, each component, $P_i$ 230, of components, $P_1, P_2, \ldots, P_k$, can be connected to the internal input port, $R_i^{IN}$ 232 and internal output port, $R_i^{OUT}$ 234. For an audio effects chain sequencing apparatus having k total component ports, there can be k total internal input ports, $R_1^{IN}, R_2^{IN}, \ldots, R_k^{IN}$ and k total internal output ports, $R_1^{OUT}, R_2^{OUT}, \ldots, R_k^{OUT}$. Each component $P_i$ 230, can transfer the audio input via the internal output port $R_i^{OUT}$ 234 to a switching unit, $B_i$ 236 that can be configured to transfer the audio input to another component $P_i$ 230. There can be a total of k switching units $B_i$ 236, from $B_1, B_2, \ldots B_k$. For each switching unit $B_i$ 236, the component where the switching unit sends the audio input can vary, and referring back to FIG. 1 the switching units can be included in the sequence selection module 110. Referring again to FIG. 2*b*, the switching unit $B_i$ 236 can send the audio input to an internal input port $R_i^{IN}$ 232, or the external output port. Multiplexers can be used as the switching units $B_i$ 236, and can be configured by the sequence selection module to send the audio input to an internal input port $R_i^{IN}$ 232, or the external output port. Multiplexers can be used as the switching units $B_i$ 236 and can be configured as a part of the sequence selection module, to send the audio input to the next component $P_i$ 230 in the component sequence.

Figure 3:
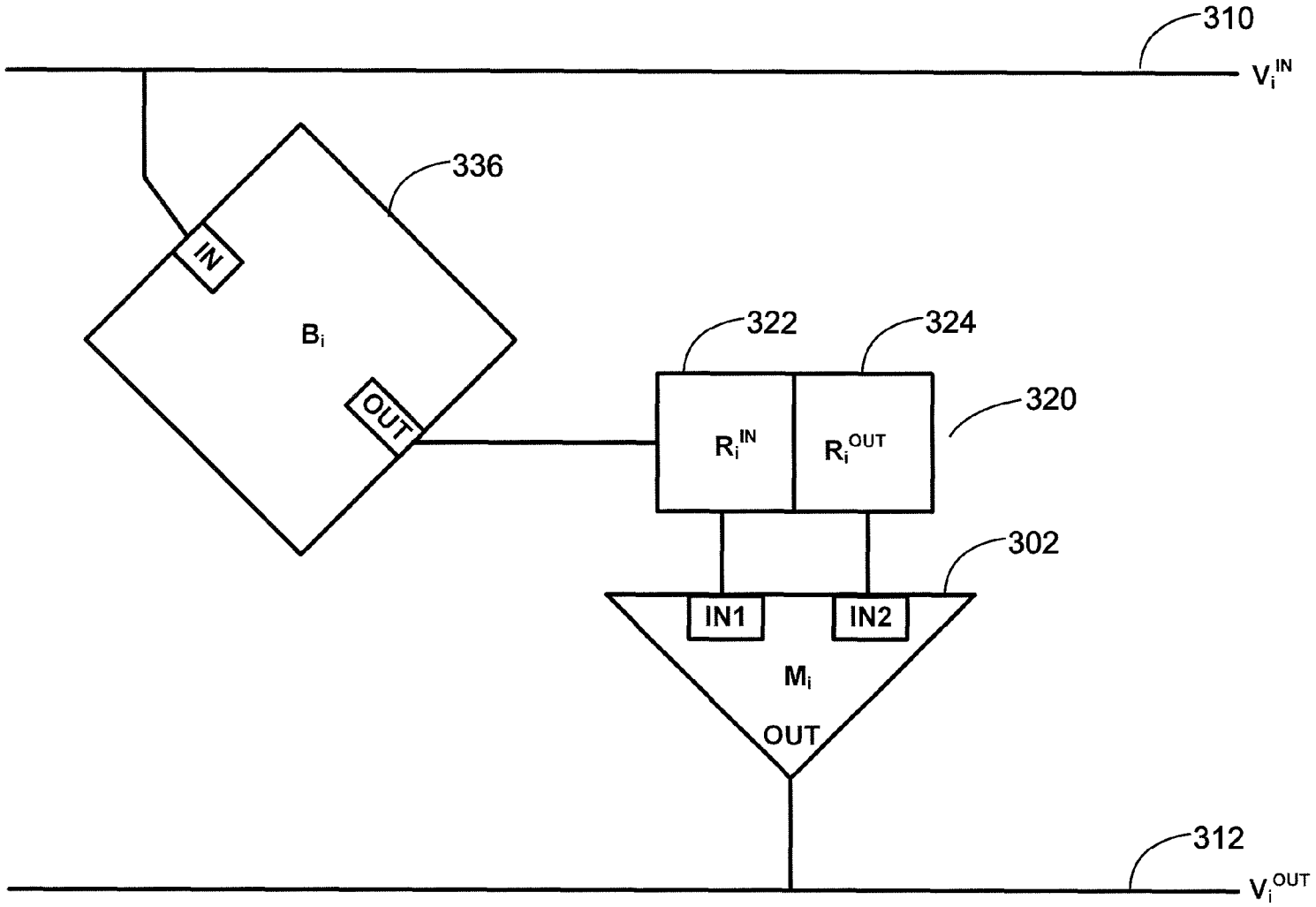
FIG. 3 is a logical block diagram of a switching unit and a mixing unit configured to "split" an input to allow for a mixing effect to be applied to the input.

Referring now to FIG. 3 a mixing module and configuration is shown which can allow a mixing module $M_i$ 302 to receive a split audio input. Mixing module $M_i$ 302 is connected to a switching unit $B_i$ 336, for k number of components. $V_i^{IN}$ 310 represents the connection bringing an audio input into $B_i$ 336 and $V_i^{OUT}$ 310 represents the connection bringing the input to the next position in the component sequence. The mixing module, $M_i$ can require two inputs to perform various mixing effects on the audio input. Switching unit $B_i$ therefore sends the signal to the splitting unit $R_i$ 320 which can use a double pole, double throw switch, where $R_i^{IN}$ 322 receives the audio input from $B_i$ 336, and transfers the audio input both to the first input of $M_i$ 302, and to $R_i^{OUT}$ 320. $R_i^{OUT}$ 320 receives the input from $R_i^{IN}$ 322 and sends the input to the second input of $M_i$. This can split the audio input and can allow $M_i$ to apply a mixing effect on the audio input.

Figure 4:
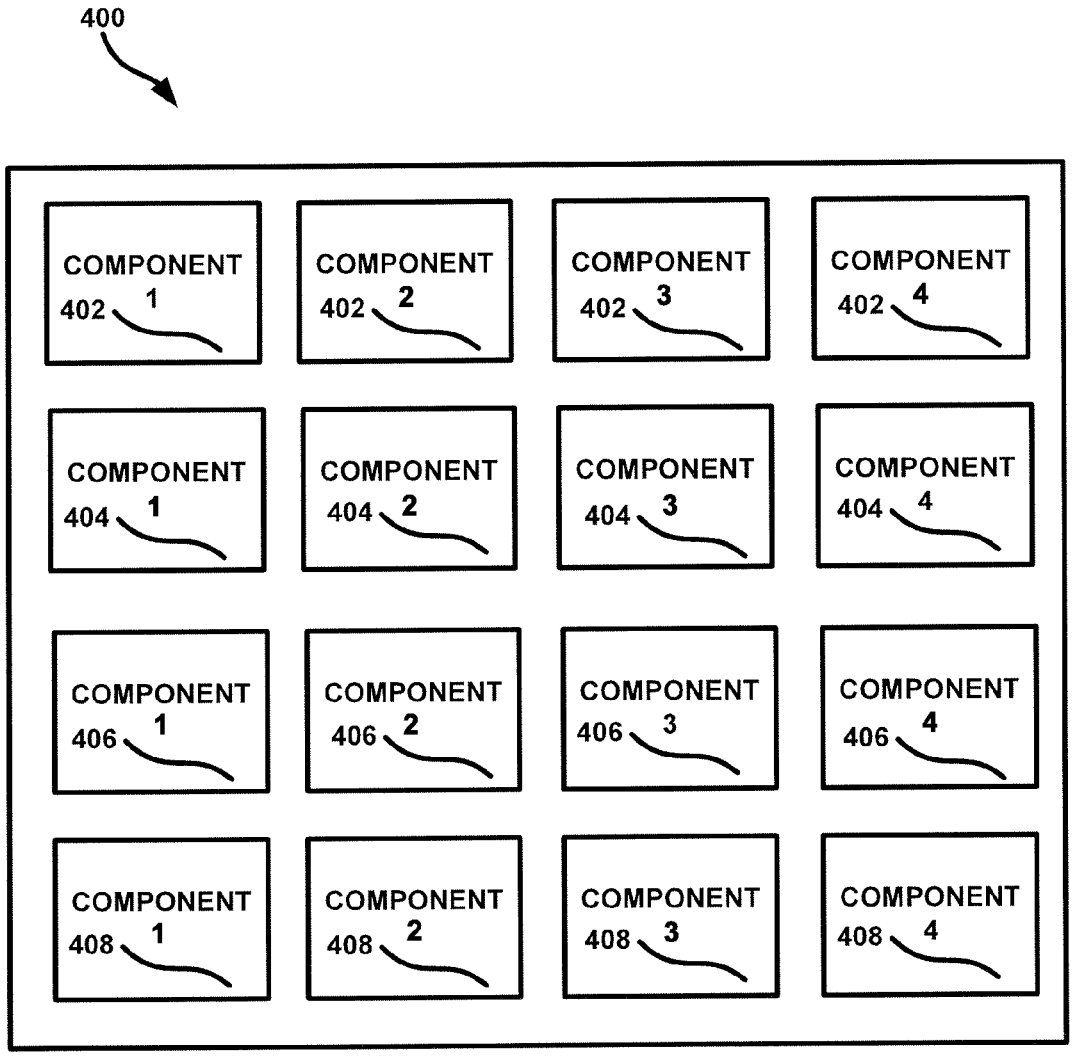
FIG. 4 illustrates an example of a user interface.

Referring now to FIG. 4 a possible user interface configuration is shown where the user interface 400 can input a sequence identifier by toggling switches 402-408 which correlate to a position in the component sequence for each component port. FIG. 4 shows a user interface utilizing a keypad for an audio effects chain sequencing apparatus which can input a sequence identifier for four component ports. In this example, the user interface 400 comprises a grid of components which select the order in which the component sequence occurs. The user can select a sequence position from rows 402-408 for each component port represented by a column. Selecting a sequence position 402-408 assigns the corresponding component port to take that position in the component sequence. For example, pressing the switch 402 for component 1 would assign component 1 to take the first position in the component sequence. Pressing switch 404 for component 2 would assign component 2 to take the second position in the component sequence. This method of assigning positions in the component sequence continues for the remaining components. The user interface 400 can be configured so that where a user selects a new position for a component port which has already been assigned a position, the user interface 400 de-selects the former component position and assigns the new position so that only one button per column can be selected at one time. The user interface 400 can be further configured so that when a user selects a component port in a position that already has a component assigned, the first component port is de-selected so that only one button per row can be selected at one time. The user interface 400 can be further configured so that a component port's position in the component sequence can be de-selected by re-selecting an already selected button. The user interface 400 can be further configured to automatically select a component position which has been freed by the selection of a new position for a component port which has already been assigned a position so that only one switch per row can be active and one button per column can be active.

Using the description provided, the invention can be implemented as a machine, process, or article of manufacture by using standard programming and/or engineering techniques to produce programming software, firmware, hardware or any combination thereof.

Any resulting programs, having computer-readable program code, can be embodied on one or more computer usable media such as resident memory devices, smart cards or other removable memory device, thereby making a computer program product or article of manufacture according to the invention. As such, terms such as "modules" and the like as used in this description are intended to include a processor-executable program that exists permanently or temporarily on any computer-usable medium. Such "modules" can also be implemented using discrete circuits.

The foregoing description of exemplary embodiments of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather determined in view of what would be apparent to those skilled in the art from the description provided herein and the claims appended hereto.

What is claimed is:

1. A component sequence reordering apparatus comprising:
   an external input port and an external output port;
   a plurality of component ports;
   an interface configured to allow a user to select a sequence for reordering; and
   a sequence selection module configured to direct an input signal from the external input port to the external output port via at least one of the plurality of component ports in a component sequence selectable by a user.

2. The component sequence reordering apparatus of claim 1, wherein the input signal comprises an audio signal.

3. The component sequence reordering apparatus of claim 1, wherein the input signal comprises at least one of an analog signal or a digital signal.

4. The component sequence reordering apparatus of claim 1 wherein the plurality of component ports each comprise an internal input port and an internal output port.

5. The component sequence reordering apparatus of claim 1, further comprising at least one mixing module configured to receive the input signal and configured to apply a mixing effect on the input signal.

6. The component sequence reordering apparatus of claim 1, further comprising a bypass module, configured to bypass zero or more of the plurality of component ports in the component sequence.

7. The component sequence reordering apparatus of claim 1, further comprising a component power supply, configured to power at least one component, connectable to the component ports.

8. A component sequence reordering apparatus comprising:
   an external input port and an external output port;
   a plurality of component ports;
   an external input port and an external output port, wherein said ports are connectable to ports selected from the group consisting of 3.5 mm mono plugs, 3.5 mm stereo plugs, 6.3 mm mono plugs, 6.3 mm stereo plugs, XLR plugs, and MIDI cables; and
   a sequence selection module configured to direct an input signal from the external input port to the external output port via at least one of the plurality of component ports in a component sequence selectable by a user.

9. A component sequence reordering apparatus comprising:
   an external input port and an external output port;
   a plurality of component ports;
   a sequence selection module configured to direct an input signal from the external input port to the external output port via at least one of the plurality of component ports in a component sequence selectable by a user;
   an interface wherein the interface generates sequence identification values to be stored in the memory;
   a memory to store one or more sequence identification values, wherein the sequence selection module is further configured to receive the one or more sequence identification values from the memory, and to select the component sequence based on the one or more sequence identification values;
   an input mechanism selected from the group consisting of a keypad, function buttons, a scrolling mechanism, a touch pad, a touch screen or combinations thereof; a display; and speakers.

10. The component sequence reordering apparatus of claim 9, wherein the sequence selection module comprises a programmable microprocessor.

11. The component sequence reordering apparatus of claim 9 wherein the interface comprises a display, configured to visibly display the sequence identification values stored in the memory.

12. The component sequence reordering apparatus of claim 11 wherein the interface is further configured to allow the user to edit the sequence identification values stored in the memory.

13. The component sequence reordering apparatus of claim 12 wherein the memory is further configured to store software configured to operate the component sequence reordering apparatus.

14. A component sequence reordering method comprising:

obtaining a sequence identification value;

identifying a component sequence based on the sequence identification value;

receiving a sequence order from a user; and configuring a circuit to transfer an input signal through a plurality of component ports in the component sequence, according to the selected order.

15. The component sequence reordering method of claim 14, further comprising storing the sequence identification value in a local memory and wherein obtaining the sequence identification value comprises retrieving the sequence identification value from the local memory.

16. The component sequence reordering method of claim 14, further comprising locally generating the sequence identification value and wherein obtaining the sequence identification value comprises retrieving the locally generated sequence identification value from a local memory.

17. The component sequence reordering method of claim 16, wherein locally generating the sequence identification value comprises receiving a component sequence configuration from a user, transforming the component sequence configuration into a sequence identification value, and storing the sequence identification value in a local memory.

18. A component sequence apparatus comprising:

an external input port and an external output port;

a plurality of component ports, each comprising an internal input port and an internal output port;

a memory;

a sequence selection module, comprising a programmable microprocessor, configured to direct the path of an input signal, from the external input port to the external output port via at least one of the plurality of component ports in a component sequence, and configured to access a sequence identification value from the memory wherein the sequence selection module selects a component sequence based on the sequence identification value;

a bypass module configured to access the sequence identification value from the memory wherein the bypass module bypasses zero or more of the plurality of component ports in the component sequence based on the sequence identification value;

a user interface, configured to generate sequence identification values to be stored in the memory; and at least one mixing module configured to receive the input signal and configured to apply a mixing effect on the input signal.

* * * * *